US005331894A

United States Patent [19]

Wassell et al.

[11] Patent Number: 5,331,894

[45] Date of Patent: Jul. 26, 1994

[54] EXPLOSIVE RELEASE COUPLING

[75] Inventors: Steven G. Wassell, West Hartford; Steven L. Renfro, Windsor Locks, both of Conn.; Harry W. Densmore, Agawam, Mass.; Scott T. Reeves, Winsted, Conn.

[73] Assignee: The Ensign-Bickford Company, Simsbury, Conn.

[21] Appl. No.: 82,611

[22] Filed: Jun. 25, 1993

[51] Int. Cl.[5] ..... C06C 5/06

[52] U.S. Cl. ..... 102/275.12; 89/1.14; 102/275.11; 102/378

[58] Field of Search ..... 102/275.12, 275.11, 102/275.7, 275.6, 378; 89/1.14

[56] References Cited

U.S. PATENT DOCUMENTS

| | | | |
|---|---|---|---|
| 3,084,597 | 4/1963 | Beyer | 89/1.14 |
| 3,486,410 | 4/1968 | Drexelius et al. | 89/1.14 |
| 4,137,848 | 2/1979 | Cunha | 89/1.14 |
| 4,664,033 | 5/1987 | Burkdoll et al. | 102/275.6 |
| 5,123,356 | 6/1992 | Brooks et al. | 102/275.12 |
| 5,129,306 | 7/1992 | Fauvel | 102/378 |
| 5,147,976 | 9/1992 | Laurensou et al. | 102/275.11 |

OTHER PUBLICATIONS

Noel, Vincent, "Sure-Sep" Separation System, McDonnell Douglas Space Systems Company, #MDC H5185, Oct. 1989.

Lake, E. Raymond, Confined Explosive Separation System, McDonnell Aircraft Company, #MDC 69-021, Jun. 1969.

*Primary Examiner*—David H. Brown

*Attorney, Agent, or Firm*—Victor E. Libert; Frederick A. Spaeth

[57] ABSTRACT

A detonation manifold (30) for use with a separation device comprising an expansion member (10) disposed in a frangible joint (24), the expansion member comprising a flattened containment tube (20) having in cross section an oblong configuration having a major axis and a minor axis and having therein a detonation fuse (16). The manifold comprises a body portion (31) having at least one initiation port (32) for receiving an initiator device and at least one coupling flange (38) mounted on the body portion for engaging the expansion member and having a flange bore (40) for receiving the detonation fuse (16), the flange bore (40) being in detonation communication with the initiation port (32). The coupling flange (38) has in cross section an oblong configuration having a major axis and a minor axis and is dimensioned and configured so that the containment tube (20) can be flared for receiving the flange without significantly deforming the oblong configuration of the containment tube (20).

6 Claims, 3 Drawing Sheets

EXPLOSIVE RELEASE COUPLING

BACKGROUND OF THE INVENTION

1. Field of the Invention

This invention relates to separation devices and more specifically, to non-contaminating separation devices.

Separation devices are used when it is desired to effect a separation of two structures that were previously adjoined to one another. Such devices typically join the structures to be separated but are later severed to release the structures from one another. A linear explosive charge, such as a mild detonating fuse, is disposed along the separation line, which may be designed to have a vulnerability to the detonation of the fuse. When separation is desired, the fuse is detonated, rupturing the device and thus allowing the structures to separate. A common application for such a separation device is in the aerospace industry, for the separation of rocket stages or for the release of payloads from cargo holds.

2. Related Art

U.S. Pat. No. 3,486,410 to Drexelius et. al., dated Dec. 30, 1969, discloses a conventional separation device comprising an expansion member comprising a detonating cord 18 disposed within a containment tube 22 where it is retained therein by support member 20. The expansion member is disposed about the perimeter of a panel 12 (FIG. 1) that is to be jettisoned from structure 10 by severing the panel therefrom along a groove 62. The explosive detonating cord is coupled to a detonator through a threaded coupling, so that it is necessary that a threaded member 50 be sealably attached to tube 22. Further, an end booster is connected to the end of cord 18 (column 4, lines 17–38). The initiator also contains an explosive detonator 42 that includes a bridge wire, whereby the detonator is electrically initiated. The containment tube has a conventionally flattened configuration so that detonation of the cord therein causes pronounced expansion of the tube in a sideways direction. Upon detonation of cord 18, the expansion member expands, fracturing panel 12 along groove 62 due to the sideways expansion resulting from detonation.

It is also known in the art to join an expansion member to an initiating device through the use of a detonation manifold. The manifold has initiation ports within which an initiating device is disposed and has flanges for receiving the ends of the containment tube and for disposing the detonation charge or fuse of the expansion member in detonation signal communication with the initiation device. The flange has a bore that communicates with the initiation port where the initiation device may be disposed. The detonation charge of the expansion member may be inserted into the flange bore so that it comes into detonation transfer relation with the initiation device. Conventionally, the flange is dimensioned and configured to have a circular external cross-sectional configuration. Accordingly, to engage the containment tube to the flange, it is necessary to flare the end of the tube significantly from its original flattened configuration to a circular configuration. Flaring the tube to this degree introduces significant stresses into the tube which may result in fractures upon detonation. The tube is then crimped circumferentially about the flange in a roll crimp procedure. It is further necessary to secure the circular crimps with retaining bands to assure that the crimps will not be undone upon detonation of the cord.

Accordingly, there is a need for a way to couple expansion tubes to detonation manifolds that result in less stress to the containment tube and, preferably, that is easier to accomplish than conventional means.

SUMMARY OF THE INVENTION

Generally, this invention provides a detonation manifold for coupling an initiating device to the detonation fuse of an expansion tube in a separating device in a manner that reduces flaring stress imposed upon the containment tube while still providing a reliable joinder of the tube to the manifold.

More specifically, the invention relates to a detonation manifold for use with a separation device comprising an expansion member disposed in a frangible joint, the expansion member comprising a flattened containment tube having in cross section an oblong configuration having a major axis and a minor axis and having therein a detonation fuse. The manifold comprises a body portion having at least one initiation port for receiving an initiator device and at least one coupling flange mounted on the body portion for engaging the expansion member and having a flange bore for receiving the fuse, the flange bore being in detonation communication with the initiation port. According to the present invention, the coupling flange has in cross section an oblong configuration having a major axis and a minor axis and is dimensioned and configured so that the containment tube can be flared for receiving the flange while maintaining an oblong configuration of the containment tube.

According to another aspect of the invention, the coupling flange may be dimensioned and configured to have an interference fit in the expansion member in the region of the minor axes of the coupling flange and the containment tube.

According to one aspect of the invention, the coupling flange may comprise crimp notches on its outer surface to facilitate engagement of the expansion member with the flange by crimping the containment tube onto the coupling flange. The crimp notches may be diametrically opposed on the manifold, to facilitate stake crimping.

Optionally, this invention may include a securing clamp dimensioned and configured to secure onto the coupling flange the flared end of a containment tube crimped thereon. Optionally, a sealant may be applied to the coupling flange to fill any voids between the coupling flange and a containment tube crimped thereon.

BRIEF DESCRIPTION OF THE DRAWINGS

FIGS. 1A, 1B and 1C represent conventional features of the prior art, in which FIG. 1A is a cross-sectional view of a conventional expansion member;

FIG. 1B is a partially cross-sectional view of a separation device including the expansion member of FIG. 1A;

FIG. 1C is a view similar to that of FIG. 1B of the separation device of FIG. 1B after detonation, showing fracture of the separation device;

DETAILED DESCRIPTION OF THE PREFERRED EMBODIMENT

The present invention relates to a detonation manifold for coupling a separation device to an initiator. Typically, the separation device comprises an expansion member disposed within a frangible joint. The frangible joint comprises a pair of joinder flanges interconnected by a release portion. Before separation, the joinder flanges are secured to respective structures, e.g., a fairing or a field joint adapter on a rocket, missile or payload platform, that are to be separated, and the release portion keeps the assembly together. Typically, the release portion comprises a channel within which is disposed the expansion member. The release portion usually has a groove disposed along the channel to provide a fracture seam. The expansion member comprises a deformable containment tube within which an elastomeric charge holder supports a detonation charge, typically a mild detonation fuse. Upon detonation, the charge causes the expansion tube to expand and fracture the release portion of the frangible joint along the groove, thus separating the structures. The containment tube prevents the release of shrapnel and of chemical by-products of the detonation of the charge in the expansion member, thus preventing damage to the structures or objects therein from shrapnel or other detonation by-products. Such separation devices find utility in aerospace applications, particularly in the release of rocket stages, the opening of cargo holds, and/or the release payloads.

Figure 1B:
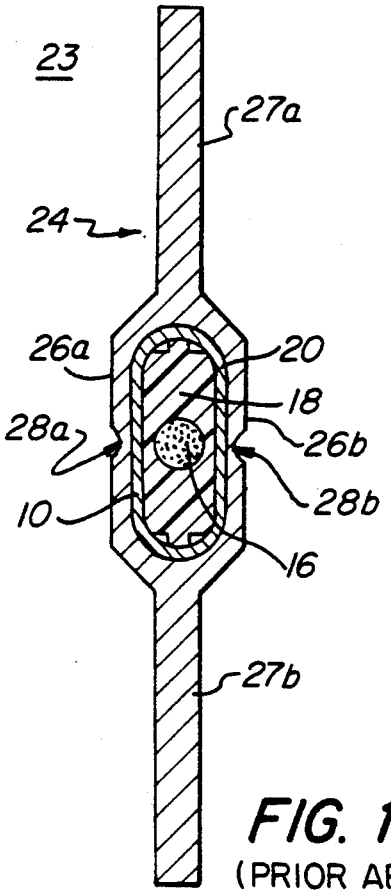
FIG. 1B (PRIOR ART)
Figure 1C:
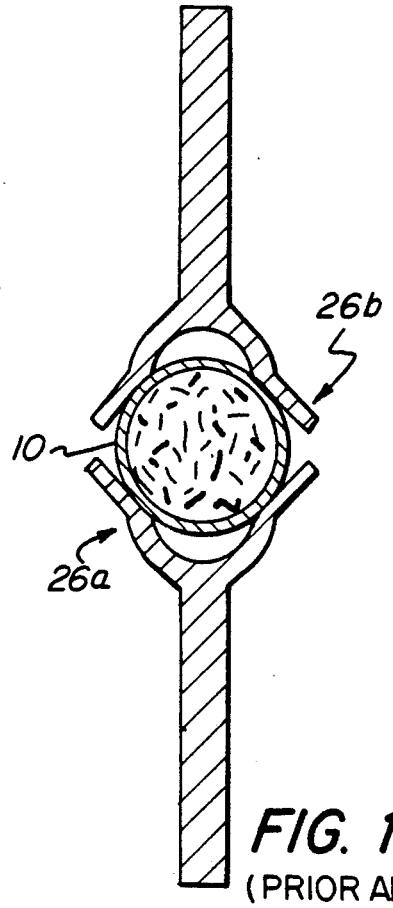
FIG. 1C (PRIOR ART)
Figure 1A:
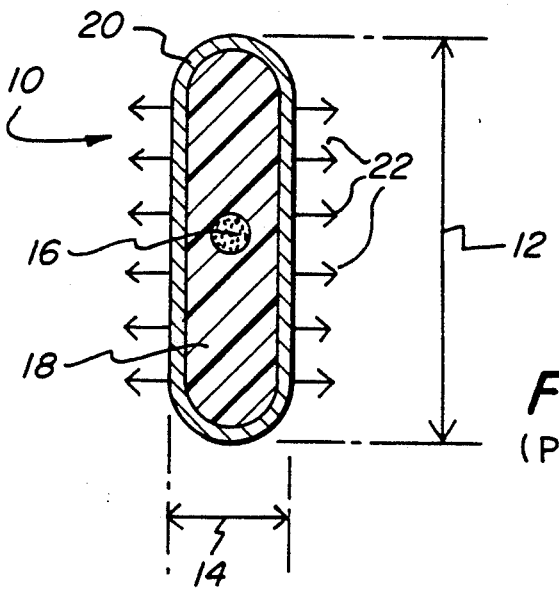
FIG. 1A (PRIOR ART)

There is shown in FIG. 1A a cross-sectional view of a conventional expansion member 10 having an oblong configuration characterized by a major axis 12 and a minor axis 14. Expansion member 10 comprises a containment tube 20 that is typically formed by flattening round tubing. Within containment tube 20 is an elastomeric charge holder 18 within which is disposed a linear detonatable charge such as a mild detonation fuse 16. One suitable charge is a mild detonation fuse known under the designation HNS-IIA Mild Detonating Fuse. Such a fuse typically contains a core of 24 grains per linear foot HNS in an aluminum jacket. However, it will be appreciated that other detonation materials such as HMX can be used as well. The elastomeric charge holder 18 is commonly made from a silicone polymer.

Upon detonation of mild detonation fuse 16, containment tube 20 expands most prominently along its minor axis, as indicated by expansion arrows 22. Containment tube 20 is made of a material like stainless steel that is sufficiently flexible to allow for the expansion as indicated by expansion arrows 22, but is also strong enough not to fracture or be perforated by shrapnel released by fuse 16, to completely contain the debris released upon detonation of fuse 16.

A typical separation device 23 is shown in cross section in FIG. 1B, in which expansion member 10 is disposed within a frangible joint 24 which may be an extruded aluminum member having a release portion comprising separation walls **26*a*, 26*b* defining an internal channel for receiving expansion member 10. Frangible joint 24 comprises joinder flanges 27*a*, 27*b* mounted to the release portion for attachment to the structures to be separably attached. Thus, prior to separation, frangible joint 24 functions like a butt plate. Generally, the expansion member 10 is inserted lengthwise into the channel formed in the frangible joint. Walls 26*a*, 26*b* have fracture grooves 28*a*, 28*b* that are designed to provide a clean fracture of walls 26*a*, 26*b* in response to expansion of the expansion member 10 upon detonation of fuse 16, whereupon expansion member 10 will expand laterally to a substantially circular cross-sectional configuration as shown in FIG. 1C, thus fracturing walls 26*a* and 26*b* along the length of the separation device. Thus, joinder flanges 27*a*, 27*b*** and their associated structures are separated upon detonation of the detonation fuse.

Figure 2:
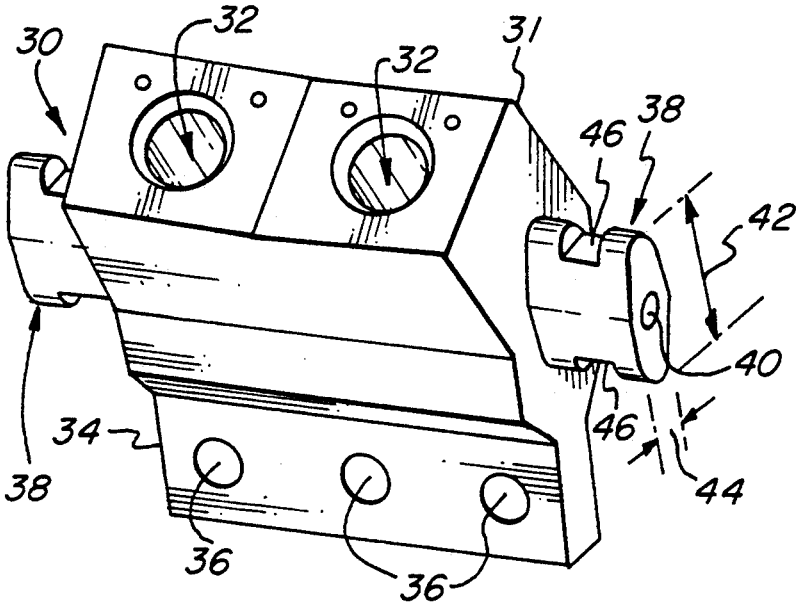
FIG. 2 is a perspective view of a detonation manifold comprising a coupling flange according to the present invention.

The present invention provides a detonation manifold for joining an initiation device to the detonation fuse of an expansion member in a separation device. A detonation manifold 30 according to the present invention is seen in FIG. 2 and includes a body portion 31 having two initiation ports 32 for receiving a primary and a redundant initiating devices. Detonation manifold 30 includes a mounting flange 34 formed with fastening holes 36 that allow manifold 30 to be attached to one of the structures to be separated. Detonation manifold 30 includes two coupling flanges 38 each having a flange bore 40 therein. Flange bore 40 communicates with initiation port 32 so that a detonation fuse 16 may be passed therethrough into detonation relation with the initiating device in initiation port 32. As indicated above, coupling flange 38 has, in cross section, an oblong configuration having a major axis 42 and a minor axis 44. Further, coupling flange 38 is equipped with a pair of crimp notches 46 that facilitate the formation of a secure crimp engagement between an expansion member and the detonation manifold. Crimp notches 46 are diametrically opposed on the major axis 42 of the manifold to facilitate a stake crimp operation.

Figure 3:
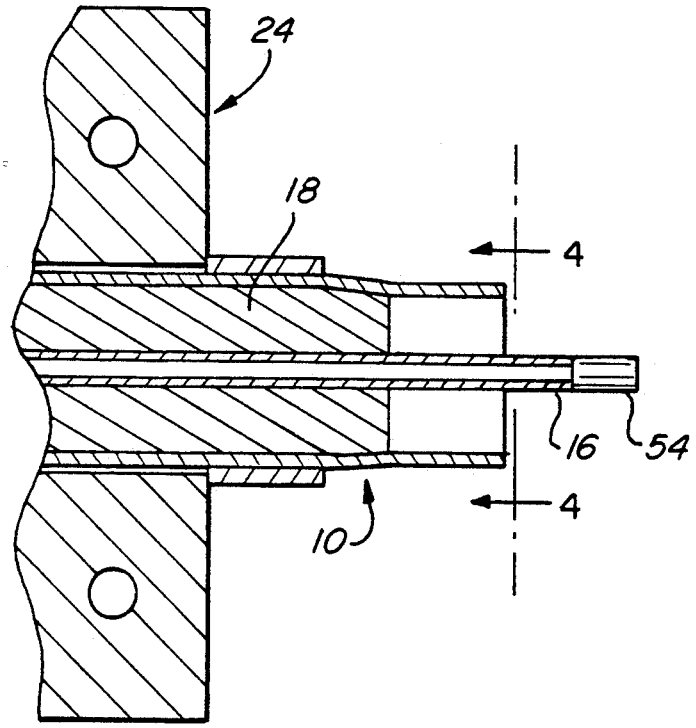
FIG. 3 is a schematic cross-sectional view of the separation device with the containment tube slightly flared laterally prior to coupling with the manifold of FIG. 2.
Figure 4:
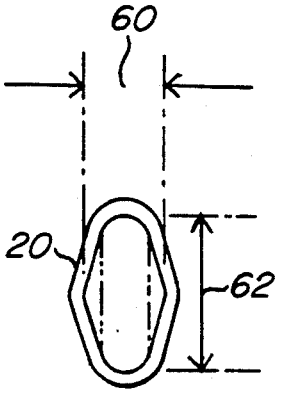
FIG. 4 is an elevational view of the containment tube of FIG. 3 after being flared.

To facilitate joinder of expansion member 10 to detonation manifold 30, expansion member 10 is extended out of frangible joint 24 as seen in FIG. 3 and a portion of elastomeric charge holder 18 is removed from within containment tube 20. Before detonation fuse 16 is inserted into flange bore 40, a booster cap 54 is attached to its end. Such a booster cap may comprise, e.g., a charge of about 96 mg of a HNS-IA explosive. Further, the portion of containment tube 20 which is to receive coupling flange 38 is slightly flared from the configuration shown in FIG. 1A by increasing its width along its minor axis, as shown in FIG. 4, producing a slight reduction in its length along the major axis. This type of flaring is in contrast to the prior art, wherein containment tubes have conventionally been flared to circular configurations, causing significant degrees of stress in the tube. Such stresses produce regions in the tube near the coupling flanges that are vulnerable to fracture upon detonation and therefore may release unwanted debris that may damage the separating structures or payload.

Figure 5:
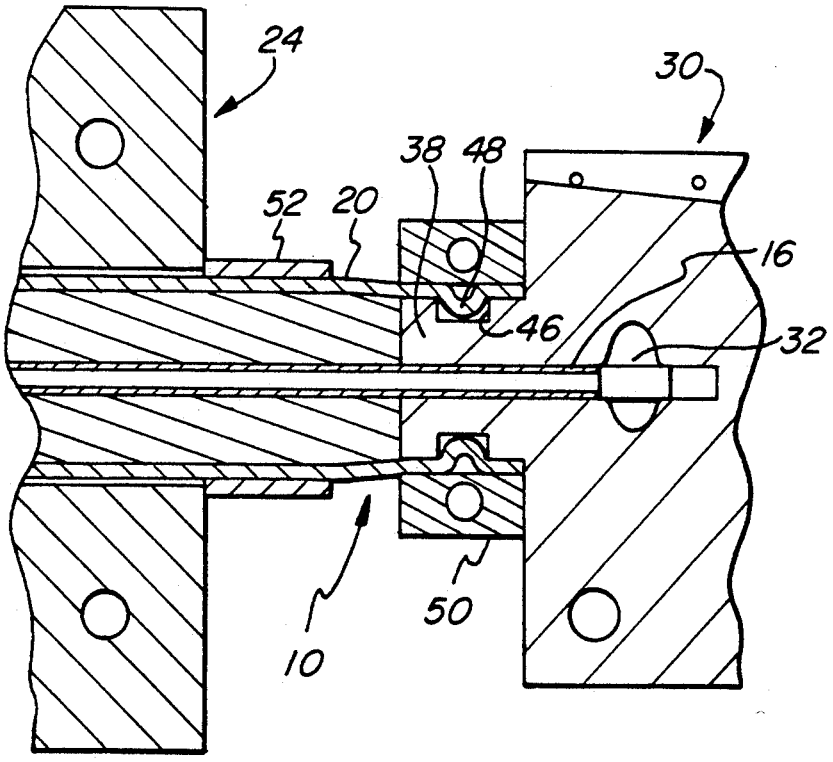
FIG. 5 is a schematic cross-sectional view of a separation device coupled to the detonation manifold of FIG. 2.

When fully assembled, the separation device 23 and detonation manifold 30 are joined in the manner illustrated in FIG. 5. The detonation fuse 16 is inserted into the flange bore 40 (FIG. 2) of coupling flange 38 (FIG. 2) to a point where it passes into initiation port 32, which is illustrated as having an ovoidal configuration because, although it is circular in cross section, initiation port 32 is disposed at an oblique angle with respect to the plane of FIG. 5. The flared end of containment tube 20 is preferably dimensioned and configured to pass over coupling flange 38 in an interference fit of their respective minor axes; a slight gap between tube 20 and coupling flange 38 is tolerable along the major axes since the tube is secured onto the flange by a crimp 48 at crimp notches 46 diametrically opposed on the major axis of coupling flange 38. Due to the configuration of coupling flange 38 and flared end of tube 20, an effective crimp may be achieved by stake crimping, a much simpler operation than the roll crimp practiced in the prior art. Preferably, before coupling flange 38 is received within containment tube 20, the respective structures are treated with a sealant such as epoxy to fill in any voids that may remain after the crimping operation. An appropriate sealant is sold by 3M under the designation 2216 epoxy. To further assure a successful engagement between expansion member 10 and coupling flange 38, a locking collar 50 may be secured about coupling flange 38 after containment tube 20 is crimped thereon. It may be expedient to shape the flared end of the containment tube to conform to the locking collar when the tube is flared. Although it is generally not necessary to do so, it is preferred to provide reinforcement of the exposed portion of containment tube 20 by placing a reinforcement ring 52 thereon before engaging expansion member 10 with detonation manifold 30.

In a particular embodiment, the containment tube may be formed from a tube that was originally circular in cross-sectional configuration with a 0.625 inch (15.8 mm) outer diameter and 0.049 inch (1.2 mm) wall thickness, and made from a resilient material such as stainless steel type 304L tubing that meets MIL-T-8C06. The circular tube may be flattened as seen in FIG. 1A to have a major axis 12 of about 0.80 inches (20.574 mm) and a minor axis 14 of about 0.30 inches (opposing outer walls). An appropriately configured coupling flange may have a cross-sectional configuration having a major axis of approximately 0.67 inches (17.02 mm) and a minor axis of about 0.31 inches (7.87 mm). The flange bore may have a radius of about 0.15 inches (3.8 mm) and may extend about 1.3 inches (33.2 mm) into the detonation manifold. The coupling flange may extend about 0.5 inches (12.7 mm) from the side of the body portion of the detonation manifold, so that the flange bore extends about 0.8 inches (20.32 mm) into the body portion, passing through an initiation port in the body portion. The center of the associated initiation port may be about 0.45 inches (11.43 mm) from the side of the body portion. The end portion of the containment tube may then be flared or swaged slightly to have a minor interior axis 60 (FIG. 4) of about 0.31 inches (7.87 mm) and a major interior axis 62 of about 0.67 inches (17.02 mm). Thus, the tube is only slightly flared but nonetheless is configured for a close fit on the coupling flange.

When the detonation fuse 16 is fully inserted into the flange bore 40, an initiation device inserted into the initiation port 32 is disposed in detonation relation with detonation fuse 16, at right angles thereto. The typical initiation device may be a flexible confined detonating cord (FCDC) having a cup on the end loaded with an HNS-IA charge. To effect separation, the initiation device, the FCDC is detonated, and the HNS-IA loaded cup detonates booster cup 54 on the detonation fuse 16 of the expansion member 10. Preferably, detonation manifold 30 is dimensioned and configured to fully contain these detonation reactions, i.e., to inhibit the release therefrom of shrapnel or other detonation byproducts. The detonation of detonation fuse 16 causes the flattened containment tube 20 to expand laterally as shown in FIG. 1A, fracturing the frangible joint at grooves 28*a*, 28*b*, thus separating joinder flanges 27*a*, 27*b* and the associated structures.

As described above, a detonation manifold having a coupling flange that has an oblong configuration according to the present invention provides at least two significant advantages over the prior art manifolds. First, the containment tube, which conventionally has a cross-sectional configuration of a flattened ovoid, need only be flared slightly for engagement with the coupling flange. This produces less stress in the containment tube and reduces the risk that the tube may fracture upon detonation and release unwanted debris. Second, with a detonation manifold according to the present invention, a debris-containing crimp may be achieved by stake crimping, which is a much simpler operation than roll crimping, which was necessary with circular coupling flanges of the prior art.

While the invention has been described in detail with respect to a single embodiment thereof, it will be apparent that upon a reading and understanding of the foregoing, numerous alterations to the described embodiment will occur to those skilled in the art and it is intended to include such alterations within the scope of the appended claims.

What is claimed is:

1. A detonation manifold for use with a separation device containing an expansion member disposed in a frangible joint, the expansion member comprising a flattened containment tube having in cross section an oblong configuration having a major axis and a minor axis and having therein a detonation fuse, the manifold comprising:

a body portion having at least one initiation port for receiving an initiator device; and at least one coupling flange mounted on the body portion for engaging the expansion member and having a flange bore for receiving the fuse, the flange bore being in detonation communication with the initiation port, wherein the coupling flange has in cross section an oblong configuration having a major axis and a minor axis and is dimensioned and configured so that the containment tube can be flared for receiving the flange while maintaining an oblong configuration of the containment tube.

2. The manifold of claim 1 wherein the coupling flange comprises crimp notches on its outer surface to facilitate engagement of the expansion member with the coupling flange by crimping the containment tube onto the coupling flange.

3. The manifold of claim 2 wherein the crimp notches are diametrically opposed on the manifold to facilitate stake crimping.

4. The manifold of claim 1 or claim 2 wherein the coupling flange is dimensioned and configured to have an interference fit in the expansion member in the region of the minor axes of the coupling flange and the containment tube before being crimped thereon.

5. The manifold of claim 1 or claim 2 in combination with a securing clamp dimensioned and configured to secure onto the coupling flange the flared end of a containment tube crimped thereon.

6. The manifold of claim 1 or claim 2 in combination with a sealant for sealing any voids that remain between the coupling flange and a containment tube crimped thereon.

* * * * *

UNITED STATES PATENT AND TRADEMARK OFFICE

CERTIFICATE OF CORRECTION

PATENT NO. : 5,331,894

DATED : July 26, 1994

INVENTOR(S) : Steven G. Wassell et al

It is certified that error appears in the above-indentified patent and that said Letters Patent is hereby corrected as shown below:

In column 3, line 40, after "the release," insert --of-- .

In column 4, line 23, after "primary" insert --device-- ; and in line 24, replace "devices" with --device-- .

In column 5, line 35, replace "20.574 mm" with --20.32 mm ; in line 36, after "0.30 inches" insert --(7.62 mm)-- ; and in line 62, replace "the FCDC" with --, i.e., the FCDC,-- .

Signed and Sealed this

Eighteenth Day of July, 1995

*Attest:*

Bruce Lehman

BRUCE LEHMAN

*Attesting Officer*

*Commissioner of Patents and Trademarks*